US011009226B2

(12) United States Patent
Zhao

(10) Patent No.: US 11,009,226 B2
(45) Date of Patent: May 18, 2021

(54) LED SUBMERSIBLE LIGHT

(71) Applicant: HongChun Zhao, ShenZhen (CN)

(72) Inventor: HongChun Zhao, ShenZhen (CN)

( * ) Notice: Subject to any disclaimer, the term of this patent is extended or adjusted under 35 U.S.C. 154(b) by 0 days.

(21) Appl. No.: 16/782,334

(22) Filed: Feb. 5, 2020

(65) Prior Publication Data

US 2021/0095843 A1 Apr. 1, 2021

(30) Foreign Application Priority Data

Sep. 26, 2019 (CN) ..... 201921616758.2

(51) Int. Cl.

| | |
|---|---|
| ***F21V 31/00*** | (2006.01) |
| ***F21V 23/02*** | (2006.01) |
| ***F21V 17/12*** | (2006.01) |
| ***F21V 23/04*** | (2006.01) |
| *F21Y 115/10* | (2016.01) |

(52) U.S. Cl.

CPC ..... *F21V 31/005* (2013.01); *F21V 17/12* (2013.01); *F21V 23/02* (2013.01); *F21V 23/0435* (2013.01); *F21Y 2115/10* (2016.08)

(58) Field of Classification Search

CPC ..... F21V 17/12; F21V 23/02; F21V 23/0435; F21V 31/005; F21Y 2115/10

See application file for complete search history.

(56) References Cited

U.S. PATENT DOCUMENTS 4,219,871 A * 8/1980 Larrimore ..... B63B 45/04 362/264
5,825,954 A * 10/1998 Dunn ..... G02B 6/32 385/79
6,347,881 B1 * 2/2002 Serizawa ..... F21S 43/27 362/546
9,188,315 B2 * 11/2015 Cejnek ..... B29C 66/12469
9,285,109 B1 * 3/2016 Olsson ..... F21V 29/507
2005/0237737 A1 * 10/2005 Kim ..... H05B 45/00 362/197
2014/0211474 A1 * 7/2014 Juan ..... F21V 17/164 362/267
2017/0097138 A1 * 4/2017 Di Giovine ..... F21V 5/04
2017/0373483 A1 * 12/2017 Chen ..... H01R 13/5205
2018/0045399 A1 * 2/2018 Chen ..... F21V 31/005
2019/0324182 A1 * 10/2019 Liu ..... G02B 6/0083

FOREIGN PATENT DOCUMENTS

CN 205174201 * 4/2016 ..... F21S 9/02

OTHER PUBLICATIONS

English machine translation of CN205174201 provided by Google Patents (Year: 2016).*

* cited by examiner

*Primary Examiner* — Zheng Song

(74) *Attorney, Agent, or Firm* — iPA & iPM

(57) ABSTRACT

The present disclosure is for a LED submersible light comprising a light-emitting lampshade in thread connection with a back cover to form a closed chamber housing a circuit board, lamp beads, batteries, and a control switch. A silica gel sealing ring is disposed in a positioning groove along an inner surface of the back cover. When engaged the sealing ring expands laterally in both directions to fill up spaces between internal and external threads and the positioning groove.

5 Claims, 2 Drawing Sheets

LED SUBMERSIBLE LIGHT

TECHNICAL FIELD

The present disclosure relates to the field of lighting devices, and in particular to an LED submersible light.

BACKGROUND

Submersible lights are applied to lamplight decoration and brightening underwater such as swimming pools, fish tanks and the like. Since the submersible lights are placed in the water for a long time, higher requirements are proposed for the waterproofness of the submersible lights.

Chinese patent 201520835968.6 discloses an LED submersible light, a plastic back cover is connected to the back of a plastic upper cover through threads, as shown in FIG. 2, an annular circular bead vertical to a thread axis is arranged at a thread tail end of the plastic upper cover, an O-shaped waterproof ring 4' is arranged on the circular bead, and an upper end part of the plastic back cover touches, extrudes and presses the waterproof ring by tightening the plastic back cover, so as to realize sealing. However, on one hand, the plastic back cover and the plastic upper cover are connected through the threads, which belongs to clearance fit, as a result, only a small part of the upper end part of the plastic back cover can touch the waterproof ring, and a sealing surface formed on the plastic back cover is narrow; and on the other hand, after the plastic back cover is tightened, its upper end face will drive the waterproof ring to rotate in the circumferential direction, since the outer circumference of the waterproof ring is unobstructed and the O-shaped sealing ring is soft, the waterproof ring is prone to distortion, partially offsets outward along the radial direction and is staggered from the original sealing surface, resulting in a gap between the waterproof ring and the sealing surface, external water can leak into the submersible light through the gap, so good and reliable seal cannot be achieved, and the water leakage rate is high, as a result, the defective rate of the submersible light is high. The water leakage directly causes a short circuit of an internal circuit, such that an LED lamp is burnt or a battery is scrapped, the service life is greatly shortened, and the user experience is poor.

SUMMARY OF EMBODIMENTS

In view of the shortcoming of easy water leakage of the existing LED submersible light, the present applicant provides an LED submersible light with a sound structure to greatly improve the sealing performance.

The technical solution adopted by the utility model is as follows:

An LED submersible light is provided with a circuit board therein, a plurality of LED lamp beads and a spring sheet for mounting a battery pack are arranged on the circuit board, a positioning groove is formed in a position close to an inner circumferential surface of a back cover on a bottom surface of the back cover, a sealing ring is located in the positioning groove, and when a light emitting lampshade is rotationally connected with the back cover through screw thread fit, an annular end face at the bottom of the light emitting lampshade touches and extrudes the sealing ring.

As a further improvement of the above technical solution:

A circle of annular protrusions is arranged at positions close to the inner circumferential surface of the back cover on the bottom surface of the back cover, and the annular protrusions and the bottom surface and the inner circumferential surface of the back cover form the positioning groove.

The cross section of the sealing ring is rectangular.

The sealing ring is made of a silica gel material.

A mechanical switch or an electronic switch is further arranged on the circuit board.

The electronic switch is connected with a wireless remote receiving device.

A counterweight member is arranged at the middles of the annular protrusions in the back cover.

The beneficial effects of the utility model are as follows:

In the utility model, the sealing ring is arranged in the positioning groove in the back cover, and the sealing ring generates elastic deformation under the action of an external force of tightening the light emitting lampshade on the back cover, thereby realizing the sealing between the light emitting lampshade and the back cover, enhancing the sealing effect and reducing the water leakage rate of products.

Figure 1:
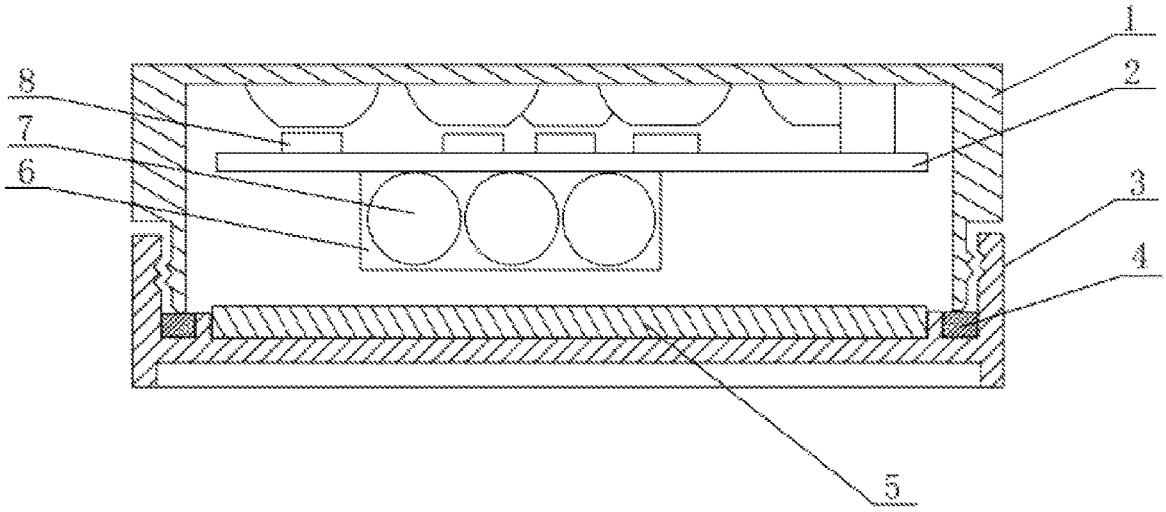
FIG. 1 is a structural schematic diagram of the prior art.

Labels in the drawings are: 1. light emitting lampshade; 2. circuit board; 3. back cover; 4. sealing ring; 5. counterweight member; 6. spring sheet; 7. battery pack; 8. LED lamp bead; 9. annular protrusion; 10. positioning groove.

DETAILED DESCRIPTION OF THE EMBODIMENTS

The specific embodiments of are described below in combination with the drawings.

Figure 2:
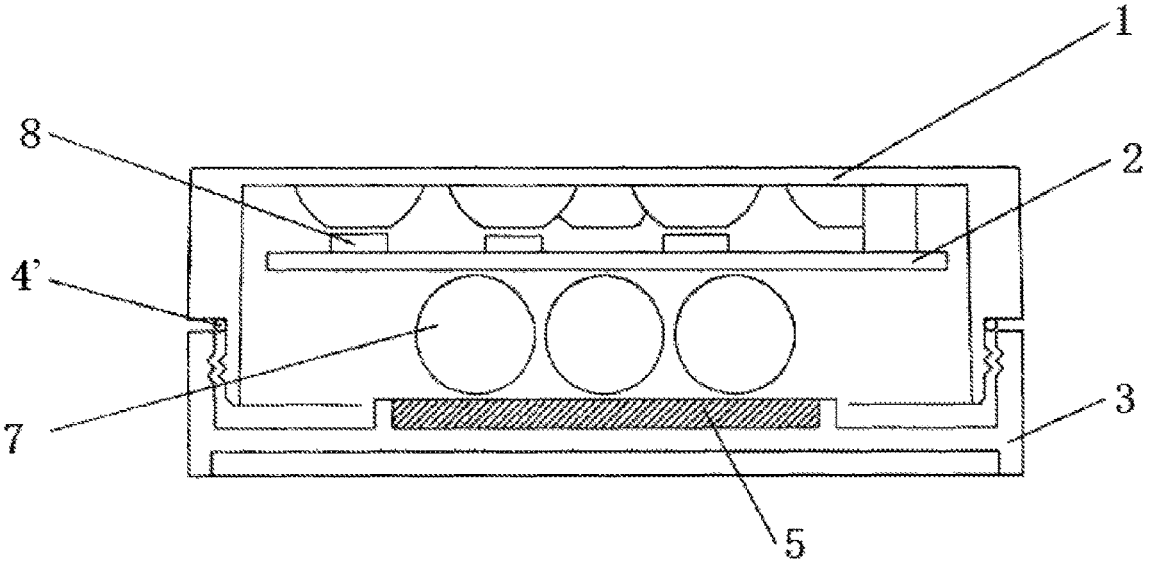
FIG. 2 is a structural schematic diagram of the utility model.

As shown in FIG. 2, a circuit board 2 of the utility model is fixed a cylindrical light emitting lampshade 1 by a fastener, a plurality of LED lamp beads 8 are arranged on an upper surface of the circuit board 2, a wireless remote control receiving device and a spring sheet 6 for mounting a battery pack 7 are arranged on a lower surface of the circuit board, and the wireless remote control receiving device is connected with an electronic switch for controlling the LED lamp beads 8. In other embodiments, a mechanical switch is arranged on the circuit board 2 to replace the wireless remote control receiving device and the electronic switch. An outer circumferential surface of the lower part of the light emitting lampshade 1 is provided with external threads, an inner circumferential surface of the upper part of the cylindrical back cover 3 is provided with internal threads matching the external threads, and the light emitting lampshade 1 is rotatably fixed to the back cover 3 through a threaded connection. The light emitting lampshade 1 is made of a light transmitting material.

Figure 3:
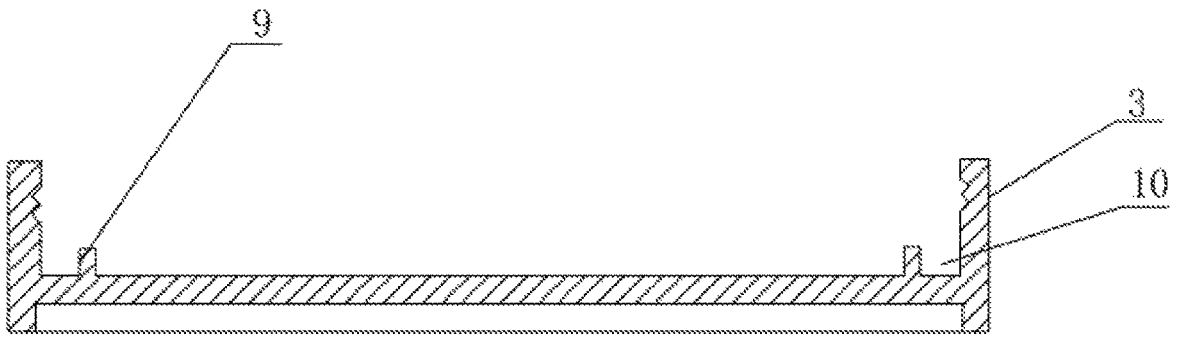
FIG. 3 is a structural schematic diagram of a back cover of the utility model.

As shown in FIG. 3, a circle of annular protrusions 9 is arranged at positions close to the inner circumferential surface of the back cover on the inner bottom surface of the back cover 3, the annular protrusions 9 and the bottom surface and the inner circumferential surface of the back cover 3 form an annular positioning groove 10, an annular sealing ring 4 is arranged in the positioning groove 10, and when the light emitting lampshade 1 is rotatably fixed in the back cover 3, an annular end face at the bottom of the light emitting lampshade 1 is aligned with the sealing ring 4. When a front face of the annular end face at the bottom of the light emitting lampshade 1 touches and extrudes the sealing ring 4, the sealing ring 4 can prevent external water from entering. A sidewall of the sealing ring 4 is next to the annular protrusions 9, and the annular protrusions 9 can restrict the radial movement of the sealing ring 4. When the light emitting lamp cover 1 and the back cover 3 are rotated and tightened, the tightening force extrudes the sealing ring 4 to move along the radial direction, and the annular protrusions 9 ensure that the sealing ring 4 is not deformed or eccentric, so that the upper end face of the sealing ring 4 always touches and extrudes the annular end face at the bottom of the light emitting lampshade 1, and the sealing effect of the sealing ring 4 is ensured. The cross section of the sealing ring 4 is rectangular, which matches the positioning groove 10. The sealing ring 4 is preferably made of a silica gel material. The bottom of the light emitting lampshade 1 is a flat annular end face, which can be completely extruded and embedded into the upper surface of the sealing ring 4, the upper surface of the sealing ring 4 is depressed and deformed due to stress during pressing fit, so that the contact surface between the sealing ring 4 and the light emitting lampshade 1 is increased; and at the same time, the side walls on both sides of the deformed sealing ring 4 abut against the annular protrusions 9 and the inner circumferential surface, respectively, to further ensure the sealing effect. A circular counterweight member 5 is placed at the middles of the annular protrusions 9 on the inner bottom surface of the back cover 3.

When the utility model is used, the sealing ring 4 is placed in the positioning groove 10 of the back cover 3, the circular counterweight member 5 is placed at the middles of the annular protrusions 9, the light emitting lampshade 1 and the back cover 3 are tightened by the external force, so that the annular end face at the bottom of the light emitting lampshade 1 touches and extrudes the upper surface of the sealing ring 4, the sealing ring 4 generates elastic deformation through the tightening force, the annular end face at the bottom of the light emitting lampshade 1 is extruded and embedded into the sealing ring 4, the bottom of the sealing ring 4 extrudes and abuts against the bottom surface of the back cover 3, the side walls on both sides of the sealing ring 4 abut against the annular protrusions 9 and the inner circumferential surface, respectively, to prevent external water from entering from the joint of the light emitting lampshade 1 and the back cover 3 and to realize the sealing of the LED light.

In the utility model, the sealing ring 4 is arranged in the positioning groove 10 in the back cover 3, and the sealing ring 4 generates the elastic deformation under the action of the external force of tightening the light emitting lampshade 1 on the back cover 3, thereby realizing the sealing between the light emitting lampshade 1 and the back cover 3, enhancing the sealing effect and reducing the water leakage rate of products. The above description is an explanation of the utility model, not a limitation of the utility model, and the utility model can be modified in any form without departing from the spirit of the utility model.

What is claimed is:

1. A LED submersible light comprising:

a light emitting lampshade having a base portion and a rim portion extending from the base portion, a back cover having a base portion and an annular inner protruding portion and an outer rim portion extending from the base portion of the back cover forming a positioning groove, wherein the rim portion of the lampshade has an external thread formed on an outer surface of the rim portion which is rotationally attachable and detachable to the back cover with a corresponding internal thread formed on an inner surface of the outer rim portion of the back cover to form a closed chamber housing a circuit board with a plurality of lamp beads and a spring sheet mounting a plurality of batteries to power the plurality of lamp beads, wherein the positioning groove is situated in close proximity to the internal thread along a bottom inner surface of the back cover between the annular inner protruding portion of the back cover and the outer rim portion to accommodate a sealing ring made of a silica gel material, and the positioning groove comprises a radius determined by a width of the sealing ring, wherein when the sealing ring is engaged by an end surface of the rim portion of the lampshade with the external thread disposed in the middle, the silica gel material of the sealing ring expands laterally in both directions to fill up spaces between the internal and external threads and the positioning groove.

2. The LED submersible light of claim 1, wherein a cross section of the sealing ring is rectangular.

3. The LED submersible light of claim 2, wherein a mechanical switch or an electronic switch is further arranged on the circuit board.

4. The LED submersible light of claim 3, wherein the electronic switch is paired with a wireless remote control device.

5. The LED submersible light of claim 1, wherein a counterweight member is affixed to the inner surface of the back cover in an area surrounded by the annular inner protruding portion.

* * * * *